US005613643A

United States Patent [19]

Weiner

[11] Patent Number: 5,613,643

[45] Date of Patent: Mar. 25, 1997

[54] CREEL

[76] Inventor: Robert S. Weiner, 1016 Old Powers Ferry Rd., Atlanta, Ga. 30327

[21] Appl. No.: 639,627

[22] Filed: Apr. 29, 1996

Related U.S. Application Data

[63] Continuation-in-part of Ser. No. 381,084, Jan. 31, 1995, Pat. No. 5,531,392.

[51] Int. Cl.[6] ..... D02H 1/00; D04B 27/10; B65H 57/00

[52] U.S. Cl. ..... 242/131; 28/190; 66/125.04; 112/163; 139/450; 242/157 R

[58] Field of Search ..... 242/42, 131, 157 R, 242/131.1, 157 C; 139/450; 112/163; 66/168, 125 A; 28/184, 185, 190

[56] References Cited

U.S. PATENT DOCUMENTS

| | | | |
|---|---|---|---|
| 2,728,132 | 12/1955 | Shattuck et al. | 242/157 R |
| 3,126,695 | 3/1964 | McGill | 242/131 |
| 3,291,160 | 12/1966 | Veney et al. | 242/42 |
| 3,716,203 | 2/1973 | Beasley | 242/131 |
| 4,151,943 | 5/1979 | Slonaker et al. | 242/157 R |
| 4,180,218 | 12/1979 | Jacobs | 242/131 |
| 4,572,458 | 2/1986 | Bluhm et al. | 242/131 |
| 4,836,468 | 6/1989 | Singer | 242/131 |
| 4,865,264 | 9/1989 | Goineau | 242/131 |
| 5,531,392 | 7/1996 | Weiner | 242/131 |

*Primary Examiner*—Michael Mansen
*Attorney, Agent, or Firm*—Alan Ruderman

[57] ABSTRACT

A creel for feeding groups of yarn strands to a textile machine has a framework of interconnected frame members and vertical support members, each support member carrying a plurality of vertically spaced yarn cone holders. A group of yarn strands is supplied from cones mounted on holders on horizontally spaced apart support members. An outermost cone holder of the group has a yarn guide tube corresponding thereto mounted on a frame member with the inlet of the tube positioned for receiving a yarn from a cone mounted on the outermost holder. Each of the other yarn cone holders has an eyelet on a respective frame member for receiving a yarn strand from a cone mounted on a yarn cone holder carried by a respective horizontally spaced support member. The yarn strand from the cone furthest from the outermost cone holder is directed by the eyelet associated with it to the next adjacent eyelet and together with the yarn from the cone on the holder associated with that eyelet directs the yarns horizontally to each subsequent eyelet and then into the guide tube so that all of the yarns are guided by the guide tube to a header.

8 Claims, 2 Drawing Sheets

CREEL

REFERENCE TO RELATED APPLICATIONS

This application is a continuation-in-part of U.S. application Ser. No. 08/381,084 filed Jan.31, 1995. Now U.S. Pat. No. 5,531,392

BACKGROUND OF THE INVENTION

This invention relates to creels for use with textile machinery such as tufting machines, warping machines or the like, and particularly to a creel wherein a group of a plurality of yarn strands are received from a like number of yarn cones and are fed through a single yarn guide tube to the textile machinery.

In textile machines, such as tufting machines, yarn is fed to the machine either directly from a creel or from a warper. A creel is a frame having an array of vertical and horizontal support members and including a multiplicity of yarn cone holders. A yarn cone is a spool about which yarn is wound. There are a multiplicity of yarn cone holders provided in horizontally and vertically disposed pairs, one cone holder of the pair mounting the active yarn cone and the other mounting a reserve or magazine cone used after the active cone is emptied. Conventionally, each cone holder pair has its own yarn guide tube through which yarn on each holder of the pair may be fed. A warper is a machine having a large spool, known in the art as a beam, on which yarn is wound and which subsequently supplies the yarn to a tufting machine.

In the art of tufting, generally a single strand of yarn is fed to each needle.

However, there are some occasions when it may be desirable to feed a plurality of fine yarn strands to each needle for providing tufted fabrics having unique patterns. Presently, when such need arises, in order to supply more than one yarn strand to a needle of a tufting machine, the yarn strands are cabled together onto a single yarn cone, or the reserve or magazine position is also used for mounting an active cone. Cabling involves winding the plural yarns onto a single yarn cone, but yarn manufacturers merchandise yarn cones with but a single yarn thereon. Thus, cabling requires unwinding the yarns from several cones and rewinding the yarns as a group onto multi-yarn cones. Cabling is therefore inconvenient and time consuming. Magazining, on the other hand, limits to two the number of yarn strands capable of being used and thus limits the pattern potential.

In co-pending U.S. application Ser. No. 08/381,084 filed Jan. 31, 1995, of which the present application is a continuation-in-part, a group of yarn cone holders of a plurality of cone holders mounted in a vertical array have all of the guide tubes except the guide tube associated with the uppermost cone holder replaced by an eyelet. The yarn strand from a cone on a lowermost cone holder is directed through and by its associated eyelet to the next vertically adjacent or second eyelet and together with the yarn from the cone on the cone holder associated with the second eyelet is directed upwardly and through each subsequent eyelet and finally to and through the guide tube associated with the uppermost cone holder. All the yarns of the group including the yarn from the cone on the uppermost cone holder are guided by the guide tube to a header. Thus, all the yarns in a vertically disposed group can be fed together to a needle of a tufting machine or the like without cabling the yarns onto a yarn cone with the limitations thereof.

It may, however, sometimes be desirable to combine the yarns of a group of horizontally disposed yarn cones in a manner which also eliminates the need for cabling. If, however, the yarns of a conventional creel are combined horizontally, there would be a mass of yarns in the location where the creel operator is positioned to service the creel, thereby preventing easy creel servicing. It should be realized that the creel operator must change yarn cones as the cones become exhausted of yarn and must also connect the leading end of the yarn on the reserve or magazine cone to the trailing end of the active cone. Thus, conventionally on at least the cone holder support post closest to the operator, the wire frame of the yarn cone holders face toward the operator.

SUMMARY OF THE INVENTION

Consequently, it is a primary object of the present invention to provide a yarn creel wherein a plurality of yarn cones may be fed horizontally to a single yarn guide tube for feeding a plurality of yarn strands for use by a needle of a tufting machine or for winding onto the beam of a warping machine or the like.

It is another object of the present invention to provide a yarn creel wherein the guides corresponding to a number of spool holders in a group of horizontally disposed yarn spool holders are replaced by eyelets and yarn from spools mounted on those holders are directed through the respective eyelet and through horizontally spaced eyelets to a single yarn guide tube corresponding to a horizontally outermost yarn spool holder of the group, the yarn on the spool mounted on the outermost holder of the group also being fed to the yarn guide tube so that all yarn strands on yarn cones in the group are received by the yarn guide tube and directed to a textile machine utilizing the plural strands of yarn.

It is a further object of the present invention to provide a yarn creel having groups of horizontally disposed yarn holders for mounting a respective yarn cone, a yarn guide tube corresponding to the outermost yarn cone holder of a group and having an eyelet corresponding to each of the other yarn holders of the group, each eyelet receiving a yarn strand from a yarn cone on the respective cone holder and the yarn strands corresponding to each cone mounted on cone holders horizontally to one side of it, and all of the yarn strands being received and carried by the yarn guide tube.

Accordingly, the present invention provides a creel for feeding yarn to a textile machine such as a tufting machine or a warper, the creel comprising a framework of interconnected support members, a plurality of horizontally spaced yarn cone mounting members fixed to spaced apart vertical support members for mounting respective yarn cones. Certain of the horizontally spaced mounting members forming a group, a first of the yarn cone mounting members of the group having a yarn guide tube mounted on a frame member spaced from the support member and opposed to the first mounting member for receiving and guiding a plurality of yarn strands, one of which corresponds to a cone mounted on the first yarn cone support member and the others corresponding to cones mounted on each of the other yarn cone support members in the group. Each of the other mounting members of the group have an eyelet associated with it disposed on a respective frame member spaced horizontally from the guide tube for receiving and guiding a yarn strand from a cone mounted on the corresponding yarn cone mounting member and yarn strands from each cone mounting member further horizontally remote from the first mounting member. Thus, each yarn strand of the group is fed through the corresponding eyelet to a next eyelet horizontally spaced apart closer to the yarn guide tube and finally to the yarn tube, and from the tube to the header leading to the textile machine. With this an arrangement, it is not necessary to cable yarns onto yarn cones as aforesaid and more than two yarn strands may be fed to a yarn using instrumentality, such as a needle, of a textile machine, such as a tufting machine. Moreover, the yarn cone mounting members face away from the location where the creel operator is normally positioned so that the horizontal array of yarns does not interfere with the servicing functions of the operator.

DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
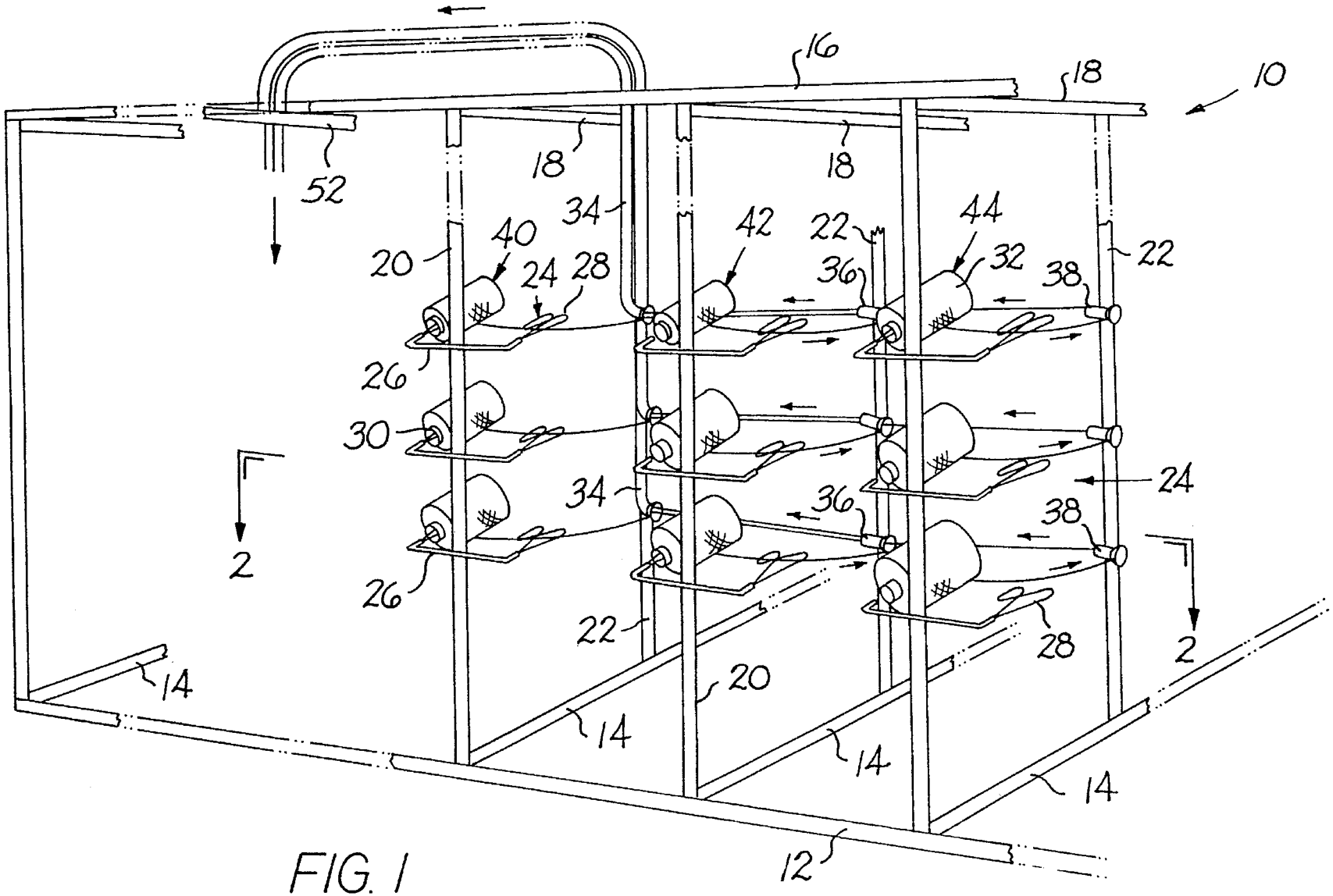
FIG. 1 is a fragmentary exploded perspective view of a creel constructed in accordance with the present invention.

A creel 10 constructed in accordance with the preferred embodiment of the present invention includes a plurality of horizontally disposed side and end support members 12, 14 forming a base of the creel, the members 14 extending substantially 90 degrees to the members 12. Spaced above and substantially parallel to each of the horizontal support members 12, 14 is a plurality of similarly disposed side and end members 16, 18 which may form the top of the creel. Secured to and extending vertically between the side members 12, 16 are a plurality of vertical support members 20. The creel thus comprises a framework in an array of vertical and horizontal support members, it being understood that the framework includes a substantial number of similar such supports and that for purposes of presentation only a small number are illustrated in FIG. 1. The length of the sides and ends of a creel of this type, for example, may be approximately 15 to 25 feet long and extend 12 to 15 feet in height. Secured at various locations between each pair of horizontal support members 14, 18 is a vertical post or frame member 22 corresponding to a vertical support member 20. Each creel post preferably comprises cylindrical pipe whereas the frame members 12, 14, 16, 18 preferably comprise angle irons.

Conventionally, as disclosed in the aforesaid co-pending application, each creel post 22 normally includes a plurality of pairs of vertically spaced apart cone holders. However, in accordance with the present invention the cone holders 24 are mounted on the support members 20. Each cone holder is formed from metal rod 26 bent into a U-shape form having a central portion and a pair of outstanding legs. The central portion of each cone holder is welded to the support member 20, and each of the legs is constructed from a wire form 28 on which a yarn cone 30, about which yarn 32 is wound, may be frictionally held. The wire form has a free end facing away from the exterior of the creel where the operator is normally positioned which, in FIG. 1 is at the front. Thus, the wire form faces toward a corresponding vertical frame member 22 and receives the yarn cone. The yarn end therefore feeds from the cone away from the operator. A cone thus may be mounted on each wire form, one of the cones actively supplying yarn, while the other is a magazine or reserve cone. Each creel support member 20 may contain a single stack of yarn cone holders 24 as illustrated.

Except for the placement and disposition of the wire forms 28 and thus the mounting of the yarn cones 30 and the direction of yarn take-off, a creel constructed as thus described is conventional and well known in the art. In the prior art there is an elongated plastic yarn guide tube such as tube 34 corresponding to eacy yarn core holder 24 having an inlet end facing the respective cone holders and an outlet end opening in a header at the top of the creel at the end facing the textile machine served by the creel. A strand of yarn from each cone is directed into the corresponding guide tube and guided to the header where it exits and is directed to the textile machine.

Figure 2:
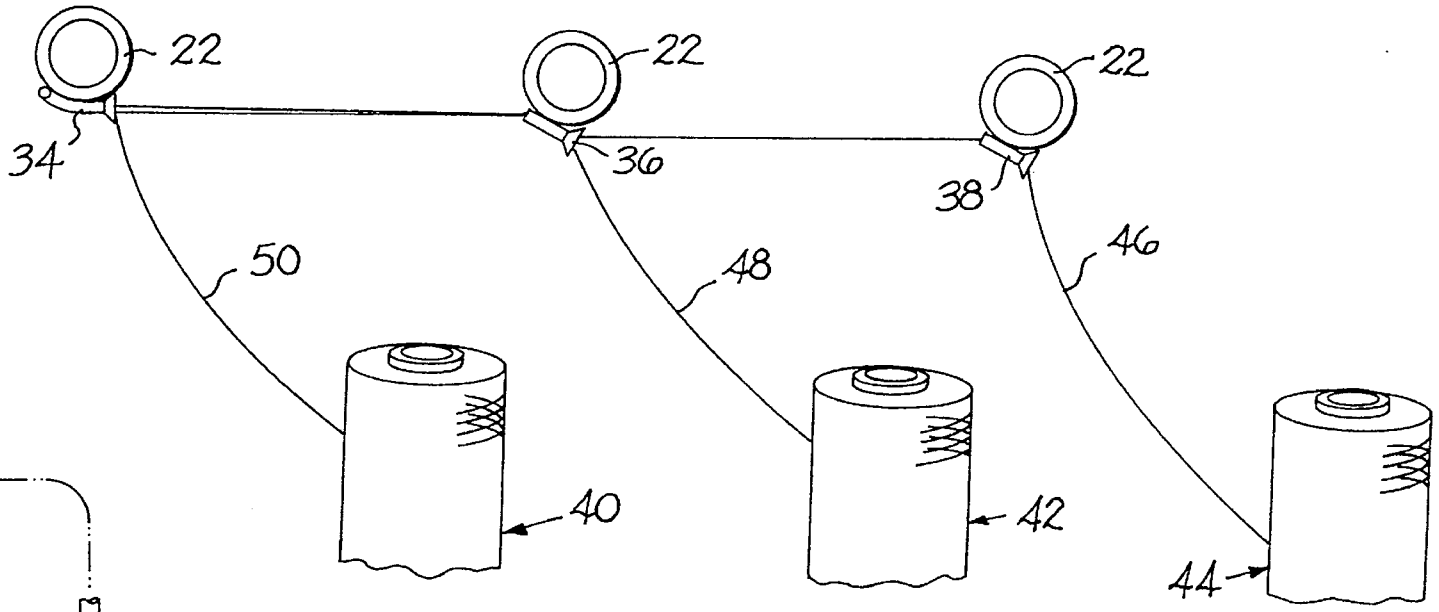
FIG. 2 is a fragmentary perspective view illustrating the manner in which yarn strands from a group of three yarn cones are guided.
Figure 3:
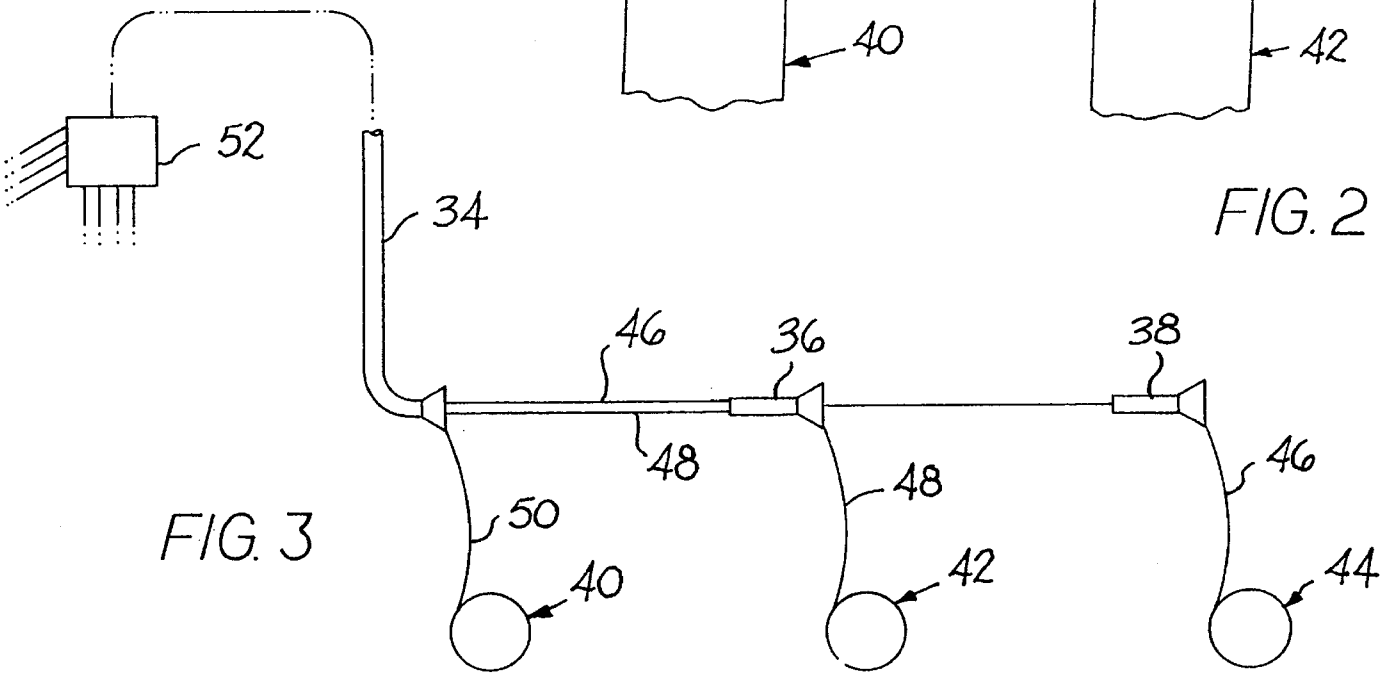
FIG. 3 is an elevational view of the apparatus illustrated in FIG. 2.

In accordance with the preferred form of the invention, the yarn strands from a horizontal group of yarn cones are fed to the inlet of a single guide tube 34, that guide tube being associated with an outermost yarn cone of the group, i.e., the cone which is either most right or most left of the group, e.g. the most left cone illustrated in the drawings. The guide tubes associated with the other yarn cones of the group are removed from the creel and replaced by eyelets 36, 38, in the form of short plastic tubes or the like, each eyelet 36, 38 being disposed substantially horizontally for receiving a respective yarn strand from a corresponding cone holder. Thus, as best illustrated in FIGS. 2 and 3, three such cones of yarn 40, 42, 44, which, of course, are mounted on spaced apart respective cone holders, may form a group in which the cones are disposed horizontally one adjacent the other at substantially the same vertical elevation. The yarn strand 46 from cone 44, which is the horizontally most remote cone of the group relative to the cone 40 with which the guide tube 34 is associated, is threaded into the eyelet 38 and directed horizontally toward and into the eyelet 36. The yarn strand 48 from the next cone 42, which is horizontally closer to the cone 40, is threaded into the eyelet 36 and directed horizontally toward the guide tube 34, or to one or more other eyelets if the group consists of one or more additional yarn cones. Thus, both yarn strands 46 and 48 are threaded into the eyelet 36 and directed horizontally. The yarn strands 46 and 48 together with the yarn strand 50 on the outermost cone 40 are thereafter threaded into the inlet of the guide tube 34. If it is desired to supply more than three yarn strands as a group to a needle of a tufting machine or the yarn using instrumentality of another textile machine, there would be other yarn cones disposed intermediate the cones 40 and 42, the number of such cones being dependent upon the number of additional yarn strands desired in the group. Each such additional yarn strand would be fed to a corresponding additional eyelet which would also receive the yarn strands 46 and 48 and all of such yarn strands would together with the yarn strand 50 be directed into the tube 34.

Each tube 34 extends into a header 52 at the top of the end of the creel most adjacent to the textile machine served, i.e., at the left end of the creel illustrated in the drawings. The yarn strands from each guide tube at the header are then withdrawn and sent to the textile machine. For example, the yarn strand from each tube may be guided and threaded into the eye of a needle so that the needle will tuft or sew with the plurality of yarn strands 46, 48, 50. It should be understood that since each yarn cone 40, 42, 44 is mounted on a respective yarn cone holder 24, the plurality of yarn cone holders corresponding to the yarn cones 40, 42, 44, etc. form a group of horizontally disposed holders, each of which has a corresponding eyelet 36, 38, etc. with the outermost cone holder, which is preferably the cone holder of the group closest to the header 52, corresponding to the yarn tube 34.

With the construction of the present invention there is but a single guide tube for each group of yarns. Since a tufting machine, for example, may have 1000 to 1500 needles, the number of guide tubes would total that amount. On the other hand, if there was a guide tube corresponding to and carrying but a single yarn strand, a group of three yarns to be fed to a single needle would require 3000 to 4500 tubes and the yarns exiting the header would cause confusion for those threading the machine.

Numerous alterations of the structure herein disclosed will suggest themselves to those skilled in the art. For example, two yarn strands may be fed, one of which is associated with an eyelet and the other with a guide tube. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of feeding a group of at least two yarn strands to a textile machine using said yarn strands from a creel having a plurality of yarn cones mounted in an array including at lea a first yarn cone and a second yarn cone, said method comprising directing first strand of yarn from said first cone to an eyelet spaced laterally from said first cone, guiding said first strand of yarn through said eyelet to an inlet of an elongated guide tube having said inlet spaced horizontally from said eyelet, directing a second strand of yarn from said second cone into said inlet, and feeding said first and second strands of yarn through said guide tube upwardly into a header towards said machine.

2. A method of feeding at least three yarn strands to a textile machine using said yarn strands from a creel having a plurality of yarn cones mounted in an array including at least a first yarn cone, a second yarn cone and at least a third yarn cone intermediate said first and second cones, said method comprising directing a first strand of yarn from said first cone to an eyelet spaced laterally from said first cone, guiding said first strand of yarn through said first eyelet to another eyelet spaced horizontally from said first eyelet, directing another strand of yarn from said third cone intermediate said first and second cones to said another eyelet, guiding said first and said another strands of yarn through said another eyelet into an inlet of an elongated tube having said inlet spaced horizontally from said another eyelet and spaced horizontally further from said first eyelet and an outlet spaced vertically above said inlet, directing a second strand of yarn from said second cone into said inlet, and feeding said first, second and another strands of yarn through said guide tube into a header toward said machine.

3. A method of feeding a group of at least three yarn strands to a textile machine using said yarn strands from a creel having a plurality of yarn cones mounted in a horizontal array including a most right yarn cone, a most left yarn cone and at least one yarn cone intermediate said right most and left most cones, said method comprising directing a first strand of yarn from said most right cone to a first eyelet spaced laterally from said most right cone, guiding said first strand of yarn through said first eyelet to a second eyelet spaced horizontally from said first eyelet, directing a second strand of yarn from a cone intermediate said most right cone and said most left cone to said second eyelet, guiding said first and second strands of yarn through said second eyelet into an inlet of an elongated guide tube having said inlet spaced horizontally from said second eyelet and an outlet spaced vertically above said inlet, directing a third strand of yarn from said left most cone into said inlet, and feeding said first, second and third strands of yarn through said guide upwardly into a header towards said machine.

4. A method of feeding a group of at least two yarn strands to a textile machine using said yarn strands from a creel having a plurality of yarn cones mounted in a horizontal array including at least a first yarn cone and a second yarn cone, said method comprising directing a first strand of yarn from said first cone to a first eyelet spaced laterally from said first cone, guiding said first strand of yarn through said first eyelet horizontally to an inlet of an elongated guide tube having said inlet spaced horizontally from said eyelet and an outlet spaced vertically above said inlet, directing a second strand of yarn from said second cone into said inlet, and feeding said first and second strands of yarn through said guide tube upwardly into a header toward said machine.

5. A creel for use with textile machinery having an array of vertical and horizontal support members, a header at a top portion of said creel, a plurality of vertical cone support members, each cone support member having a plurality of cone holders for receiving and mounting corresponding cones of yarn, several of the cone holders of horizontally spaced support members defining a group having a right most cone holder, a left most cone holder and at least one cone holder intermediate said right most and left most cone holders, a right most eyelet spaced laterally from said right most cone holder and disposed for receiving a yarn strand from a cone of yarn mounted on said right most cone holder, a single guide tube associated with said group, said guide having an inlet spaced laterally from said left most cone holder and disposed for receiving a yarn strand from a cone of yarn mounted on said left most cone holder and extending from said inlet into said header, and an eyelet spaced laterally from each cone holder intermediate said right most and left most cone holders and disposed for receiving a yarn strand from a cone of yarn mounted on a respective cone holder intermediate said right most and left most cone holders, said eyelets and said inlet of said guide tube being substantially horizontally aligned whereby yarn entering each eyelet may be received from a cone of yarn on the cone holder associated therewith and from all eyelets to the right thereof and be directed into said inlet and fed to said header with the yarn from the cones on the left most cone holder.

6. A creel as recited in claim 5, wherein each of said cone holders has a free end for receiving a respective yarn cone and a closed end, the free end of each cone holder of said group facing into said array, and said closed end facing away from said array.

7. A creel for use with textile machinery having an array of vertical and horizontal frame members, a header at the top of said creel, a plurality of vertical cone support members, at least one of said vertical frame members being disposed adjacent to and associated with each support member, each cone support member having a plurality of cone holders for receiving and mounting corresponding cones of yarn, several of the cone holders of horizontally spaced support members defining a group having a right most cone holder, a left most cone holder and at least on cone holder intermediate said right most and left most cone holders, the vertical frame member associated with the support member having the right most cone holder having a right most eyelet corresponding to the right most cone holder, the frame member associated with the support member having the left most cone holder having a guide tube having an inlet corresponding to the left most cone holder and extending into said header, and an eyelet corresponding to each cone holder intermediate said right most and left most cone holders being disposed on a frame member associated with the support member corresponding thereto, said eyelets and said inlet of said guide tube being substantially horizontally aligned for receiving yarn from a cone of yarn mounted on the cone holder corresponding thereto and for directing yarn from the eyelet corresponding to the right most cone holder to the other eyelets and into the inlet of said guide tube to said header.

8. A creel as recited in claim 7, wherein each of said cone holders has a free end for receiving a respective yarn cone and a closed end, the free end of each cone holder of said group facing into said array, and said closed end facing away from said array.

* * * * *